United States Patent [19]

Ulbing

[11] 4,217,471

[45] Aug. 12, 1980

[54] FLUIDIC ACTUATOR FOR A SWITCHING DEVICE

[76] Inventor: Otmar M. Ulbing, 1274 Lakeshore, Webster, N.Y. 14580

[21] Appl. No.: 887,824

[22] Filed: Mar. 17, 1978

[51] Int. Cl.[2] ..... H01H 35/40

[52] U.S. Cl. ..... 200/81.9 R; 91/47; 200/835

[58] Field of Search ..... 73/1 J; 91/47; 200/82 C, 81.9 R, 83 J, 83 Q, 83 S, 83 R; 251/DIG. 4

[56] References Cited

U.S. PATENT DOCUMENTS

| | | | |
|---|---|---|---|
| 3,349,801 | 10/1967 | Grundmann | 91/47 |
| 3,739,190 | 6/1973 | Whitsel | 200/81.9 R |
| 4,118,612 | 10/1978 | Gabus | 200/81.9 R |

FOREIGN PATENT DOCUMENTS

| | | | |
|---|---|---|---|
| 1293911 | 4/1962 | France | 251/DIG. 4 |

*Primary Examiner*—Gerald P. Tolin
*Attorney, Agent, or Firm*—Biebel, French & Nauman

[57] ABSTRACT

A fluidic actuator includes a retainer block having an internal regulating passage and air inlet and outlet passages interiorly connected to the regulating passage. Obstruction means, preferably a needle valve, partially obstruct the regulating passage, thereby causing a reduction in the pressure of air flowing therethrough. There is a backpressure passage within the needle valve, and this backpressure passage joins the retainer block outlet passage with a sensing cavity. The sensing cavity is covered by a diaphragm which supports a pusher. The air outlet passage is connected to an exit line, and when the end of the exit line is in any manner occluded, a backpressure condition is created within the actuator. This backpressure condition produces movement of the diaphragm, and the diaphragm in turn urges the pusher against a mechanically operated switch. A magnetic insert provides a latching capability.

10 Claims, 4 Drawing Figures

FLUIDIC ACTUATOR FOR A SWITCHING DEVICE

BACKGROUND OF THE INVENTION

In the construction of machinery it is often impossible to locate sensing components, such as bulky industrial limit switches, in congested areas of the machine. This becomes especially difficult in complex, sequentially controlled equipment, where many machine actions must be monitored to insure an orderly progress through the functional sequence.

The fluidic actuator of the present invention eliminates such problems by operating a limit switch or the like at a remote location. The actuator is connected by an air line to a small sensing head positioned in the mechanism of the machine. This makes the actuator and the actuated device easily accessible for adjustment and service.

SUMMARY OF THE INVENTION

The actuator of this invention provides novel means for supplying a flow of fluid to a distribution line leading to a work area and sensing a backpressure condition in the line when the exit end of the line is occluded. The actuator comprises a retainer block which has a fluid inlet passage and a fluid outlet passage interconnected by an internal regulating passage. Means are provided for connecting the outlet passage to the distribution line and connecting the inlet passage to a supply of pressurized fluid. In the preferred embodiment the working fluid is air.

Obstructing means are provided for restricting the flow of fluid through the regulating passage and causing a pressure drop as the fluid flows therethrough. There is a backpressure passage within the obstruction means, so that when the end of the distribution line is occluded the backpressure passage becomes filled with pressurized fluid. The retainer block has a sensing cavity which is covered by a diaphragm, and this sensing cavity is connected for a communication with the above mentioned backpressure passage. Thus, when a backpressure condition is produced within the actuator, the sensing cavity is pressurized, and the pressure is sensed by the diaphragm.

The actuator further includes a pusher which is supported against the diaphragm and positioned to produce movement of a mechanical switch or the like in response to movement of the diaphragm. In preferred embodiment the obstruction means comprises a needle valve having a frustoconical tip, and the regulating passage defines a frustoconical wall configured for close positioning around the tip of the needle valve. Latching capability is provided by a magnetic insert.

DESCRIPTION OF THE PREFERRED EMBODIMENTS

Figure 1:
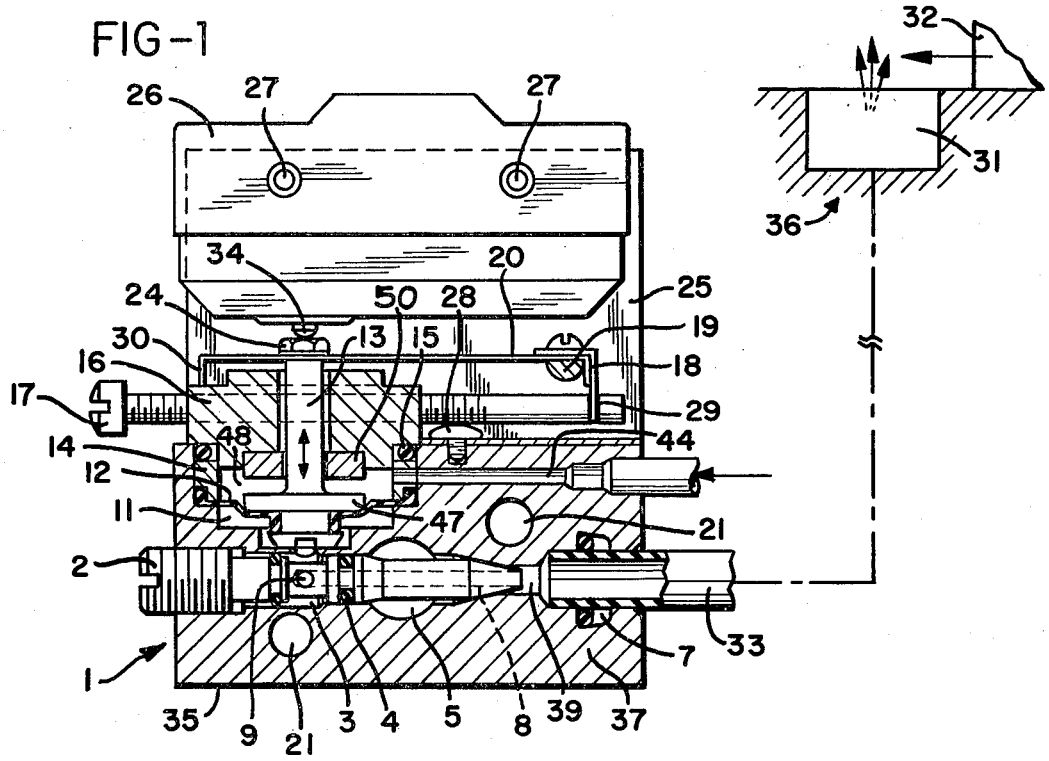
FIG. 1 is a sectioned side elevation view of a switch assembly including a fluidic actuator according to this invention.

A preferred embodiment of a fluidic actuator according to this invention is illustrated as part of a switch assembly 1 in FIGS. 1 through 4. The major elements of the switch assembly 1 are switch 26 and actuator 35. Switch 26 is mounted on actuator 35 by support brackets 25,25. An air distribution line 33 carries air from actuator 35 to a sensing head 36. Sensing head 36 has an outlet chamber 31 which is occluded from time to time by movement of a physical object as illustrated generally at 32.

Figure 2:
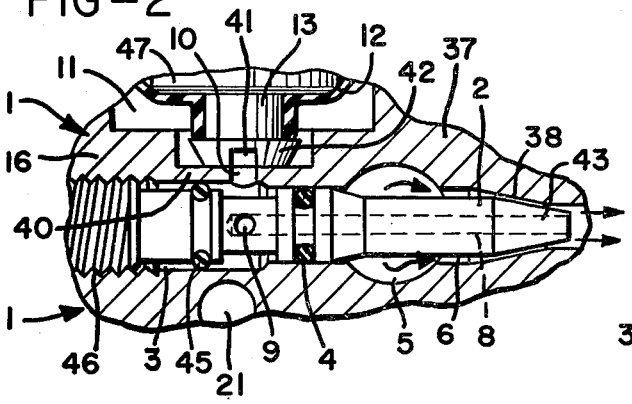
FIG. 2 is an enlarged view of a portion of FIG. 1.

As shown in FIGS. 1 and 2, actuator 35 includes a retainer block 37 having a number of passages hereinafter described in detail. A needle valve 2 is threaded into a bore 3 of retainer block 37 such that needle valve tip 43 fits within regulating passage 6. Regulating passage 6 includes a frustoconical section defined by wall 38. The wider inlet end of regulating passage 6 opens into air inlet passage 5, and the smaller exit end of regulating passage 6 leads into outlet passage 39. A connector 7 is provided at the end of outlet passage 39 for receiving the end of distribution line 33.

Also located in retainer block 37 is sensing cavity 11, connected to bore 3 by hole 10 in wall section 40. As hereinafter described, a pusher 13 rests with its head 42 against wall section 40. A transverse slot 41 in head 42 enables communication between sensing cavity 11 and bore 3 when pusher 13 is seated against wall section 40.

There is a diaphragm 12 stretched across sensing cavity 11 and supporting the lower end of pusher 13. The upper end of pusher 13 is secured to leaf spring 20 by screw 24. Screw 24 bears against pushbutton 34, which is a part of switch 26. It will be understood that pushing of pushbutton 34 opens or closes an electrical circuit of conventional design, which is housed within the body of switch 26. Screw 24 may be upwardly biased against pushbutton 34 by tension in leaf spring 20.

There is a diaphragm retainer 14 which presses against the peripheral bead of diaphragm 12. Diaphragm retainer 14 is held down by module block 16 through O-ring 15. A screw 17 engages threads in module block 16 and extends toward a reenforcement member 18, which is fastened by means of a screw to shaft 19. Shaft 19 is rotatably supported between brackets 25,25. A groove 29 at the end of screw 17 engages reenforcement member 18, so that screw 17 can be adjusted for controlling the upward spring tension of leaf spring 20 against screw 24. End 30 of spring 20 is bent downwardly to contact module block 16 in unactuated position of the switch assembly.

Switch support brackets 25,25 are fastened to retainer block 37 by screws 28. Pointed pins 27 extend through switch 26 to engage support brackets 25,25. Thus switch 26 may be removed from switch assembly 1 by a simple upwardly prying action. Brackets 25,25 also retain module block 16.

Figure 3:
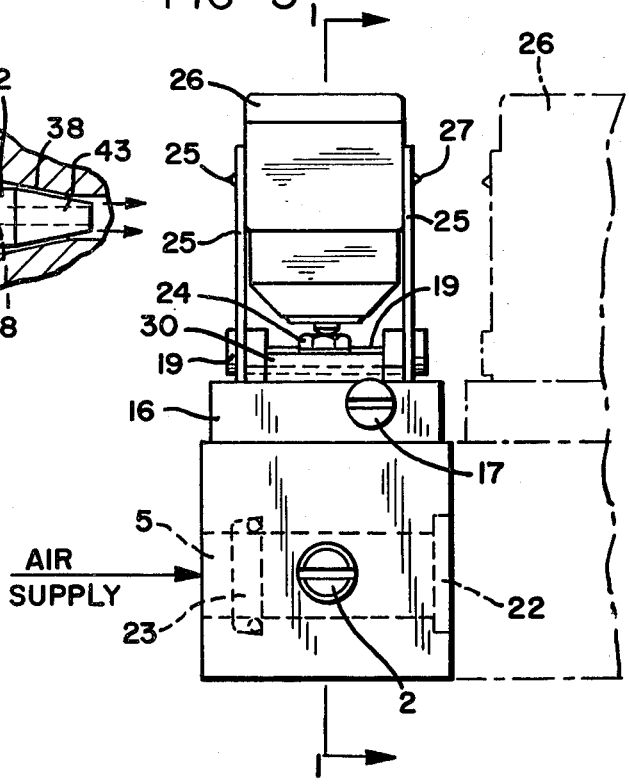
FIG. 3 is an end elevation view of the assembly of FIG. 1 as viewed from left to right in FIG. 1.
Figure 4:
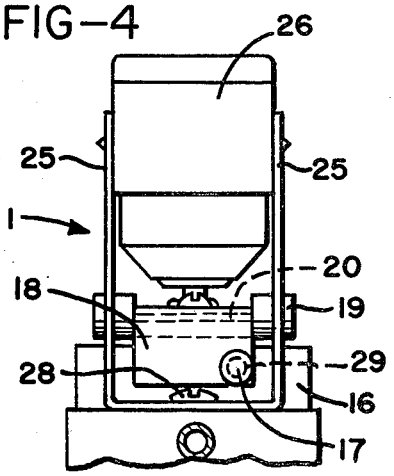
FIG. 4 is an end elevation view of a switch assembly as viewed from right to left in FIG. 1.

If desired, a number of switch assemblies, such as switch assembly 1, may be joined together as indicated by phantom lines in FIG. 3. For this purpose retaining block 37 has a pair of holes 21 for receiving assembling rods or studs (not shown). In assembled arrangement with other switching assemblies, air inlet passage 5 is sealed against similar passages in adjacent switching assemblies as indicated at 22, 23 to define a caravan manifold passage.

Referring now to FIG. 2, it will be seen that needle valve 2 blocks bore 3, thereby preventing direct flow of air from air inlet passage 5 to sensing cavity 11. Needle valve 2 has a longitudinally extending back-pressure passage 8 extending from a sidewardly extending passage 9 to the tip 43 of needle valve 2. Tip 43 has a frustoconical configuration for close positioning near the wall 38 of regulating passage 6. Passages 8 and 9 connect sensing cavity 11 to outlet passage 39. Seal 4 is provided for isolating sensing cavity 11 from air inlet passage 5. Another seal 45 prevents air leakage around threads 46 of needle valve 2.

In operation air regulated to a pressure above that required for actuation of the switching assembly is supplied through passage 5 at a pressure typically in the order of about 8 psi. Needle valve 2 is adjusted such that air flowing through regulating passage 6 is reduced in pressure to a level below that which is required for switch activation. Under normal conditions air flowing through passage 6 and around the tip 43 of needle valve 2 enters distribution line 33 and exits to the atmosphere at the opening 31 of sensing head 36.

When opening 31 is blocked by the physical object 32, there is buildup of pressure in outlet passage 39. The resulting pressure buildup feeds back through the passages 8 and 9 to bore 3 and thence through hole 10 and slot 41 to sensing chamber 11. The pressurized air in sensing chamber 11 causes upward movement of diaphragm 12 and pusher 13. This in turn actuates pushbutton 34 to complete the switching action.

The operating point or degree of occlusion to actuate the switch is adjustable both by adjusting needle valve 2 to control the air flow and by adjusting screw 17 to control the bias in leaf spring 20. Turning screw 17 for inward advancement adds to the diaphragm force required to operate the switch, while turning the screw 17 for outward movement reverses the action. The spring adjustment feature provides an operating force differential so that a number of similar or dissimilar switch modules can be accommodated. Since one end of pusher 13 is supported by diaphragm 12 and the other end by leaf spring 20, friction is substantially eliminated in this part of the system. Thus the only significant friction in the system is that of the switch itself. Repeatability is therefore excellent and operating differentials are minimized.

Once the actuator has operated as above described, it is latched in the actuated position by magnetic insert 50. For this purpose pusher 13 has a metallic rim 47, which is held firmly in place upon contact against insert 50. Resetting is accomplished by supplying pressurized air to a relief passage 44, which communicates with the upper chamber portion 48. In the latched condition there is an air tight seal between rim 47 and magnetic insert 50, so that there is no need for a seal around the shaft of pusher 13. This latching capability simplifies the control circuit logic in some applications and provides a memory function, even when power to the system has been cut.

In those applications where latching is not required, magnetic insert 50 may be omitted. For such an alternative arrangement, resetting force is supplied by switch 26, and the actuator may readily operate in reversed fashion, sensing opening as well as occlusion of exit chamber 31. As a matter of fact the reverse operation may be faster than the operation as above described, because of the fluid flow phenomenon involved. Air rushing in through regulating passage 6 and around the end of needle valve 2 creates a low pressure area at the end of passage 8 before all pressure has actually bled from the distribution line 33. Thus, on opening of exit chamber 31 the switch responds to flow rather than actual pressure drop, and opens almost immediately upon reestablishment of flow. This makes distribution lines of up to 6 foot length feasible even in high speed machinery. Typical response times with this line length are approximately 50 milliseconds to operate and about 30 milliseconds to open.

It will be appreciated that the fluidic actuator of this invention will operate readily using a liquid or a gas other than air as a working medium. For instance, distribution line 33 may be inserted into an oil sump for sensing of mechanical movement therein. In such a case inlet passage 5 would be supplied with pressurized oil rather than pressurized air.

While the forms of apparatus herein described constitute preferred embodiments of the invention, it is to be understood that the invention is not limited to these precise forms of apparatus, and that changes may be made therein without departing from the scope of the invention.

What is claimed is:

1. A fluidic actuator comprising a retainer block provided with fluid inlet and outlet passages and a regulating passage interiorly joining said inlet and outlet passages, adjustable obstruction means for partially obstructing said regulating passage and restricting the flow of fluid from said inlet passage to said outlet passage, a backpressure passage within said obstruction means for receiving fluid backed up into said outlet passage under back-pressure conditions, a sensing chamber within said retainer block and communicating with said backpressure passage, a diaphragm extending across said sensing cavity for movement in response to backpressure fluid from said backpressure passage, and a pusher mounted for actuation by movement of said diaphragm.

2. A fluidic actuator according to claim 1 and further comprising spring means for supporting the end of said pusher remote from said diaphragm.

3. A fluidic actuator according to claim 2 and further comprising bracket means for mounting a switch in position for actuation by movement of said pusher.

4. A fluidic actuator according to any of claims 1 through 3 wherein said regulating passage includes a section having a frustoconical wall and further wherein said obstruction means comprises a needle valve provided with a frustoconical tip and mounted with said tip in close proximity to said wall.

5. A fluidic actuator comprising a retainer block provided with fluid inlet and outlet passages interconnected via an internal passage having a frustoconical wall and a sensing cavity also connected to said internal passage, a needle valve provided with a frustoconical tip and a longitudinally extending internal fluid passage communicating with said tip and with a side surface of said valve, said needle valve being mounted within said retainer block such that said frustoconical tip is supported in close proximity to said frustoconical wall and said longitudinally extending passage communicates with said sensing cavity, a diaphragm extending across said sensing cavity for movement in response to fluid introduced into said cavity via the interior of said needle valve, and a pusher mounted for actuation by movement of said diaphragm.

6. A fluidic actuator according to claim 5 and further comprising means supporting a switch adjacent said pusher and a leaf spring urging said pusher toward said switch.

7. A fluidic actuator according to claim 6 and further comprising means for adjusting the tension in said leaf spring.

8. A fluidic actuator according to any of claims 5 through 7 wherein said needle valve is threadably supported for adjusting movement toward and away from said wall.

9. A fluidic actuator according to any of claims 1 through 3 or 5 through 7 and further comprising latching means for latching said pusher in the actuated position, and means defining a relief passage for carrying pressurized fluid to the back side of said diaphragm and unlatching said pusher.

10. A fluidic actuator according to claim 9 wherein said latching means comprises a magnet.

* * * * *